US010995696B2

(12) United States Patent
Mori et al.

(10) Patent No.: US 10,995,696 B2
(45) Date of Patent: May 4, 2021

(54) ENGINE

(71) Applicant: HONDA MOTOR CO., LTD., Tokyo (JP)

(72) Inventors: Kensuke Mori, Tokyo (JP); Yoshitaka Nukada, Tokyo (JP); Hiroshi Yokota, Tokyo (JP); Chiharu Kawai, Tokyo (JP); Toshiaki Deguchi, Tokyo (JP); Fumiaki Okubo, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/503,792

(22) Filed: Jul. 5, 2019

(65) Prior Publication Data

US 2020/0011269 A1 Jan. 9, 2020

(30) Foreign Application Priority Data

Jul. 6, 2018 (JP) ..... JP2018-129360
Apr. 24, 2019 (JP) ..... JP2019-083157

(51) Int. Cl.
*F02F 7/00* (2006.01)
*F02B 75/20* (2006.01)
(Continued)

(52) U.S. Cl.
CPC ..... *F02F 7/0021* (2013.01); *F02B 61/02* (2013.01); *F02B 75/20* (2013.01); *F02B 77/00* (2013.01);
(Continued)

(58) Field of Classification Search
CPC ... F02F 7/0021; F02F 2001/245; F02B 61/02; F02B 75/20; F02B 2075/1808
See application file for complete search history.

(56) References Cited

U.S. PATENT DOCUMENTS 3,694,661 A * 9/1972 Minowa ..... H02K 7/1815 290/1 R
4,513,702 A 4/1985 Koga et al.
(Continued)

FOREIGN PATENT DOCUMENTS

CN 1532389 A 9/2004
CN 101122274 A 2/2008
(Continued)

OTHER PUBLICATIONS

Official Communication dated Jul. 21, 2020 issued in the corresponding Indian Patent Application No. 201944026995.
(Continued)

*Primary Examiner* — Syed O Hasan
(74) *Attorney, Agent, or Firm* — Carrier Blackman & Associates, P.C.; Joseph P. Carrier; Anne G. Sabourin

(57) ABSTRACT

An engine includes: a crankcase; a cover that is connected to the crankcase at a mating surface of the cover inclined toward an inner side in a vehicle width direction in going downward when the engine is mounted to a vehicle body, the cover covering a protruding end of a rotary shaft; and attachment bosses that are formed to be integral with the cover, have a predetermined height from the mating surface, and accept fastening members for fastening the cover to the crankcase. Accordingly, when mounted on a two-wheeled motor vehicle, the engine can restrain protrusion in the vehicle width direction and can be disposed at a position as low as possible with reference to the vehicle.

12 Claims, 9 Drawing Sheets

(51) Int. Cl.

| | |
|---|---|
| ***F02B 61/02*** | (2006.01) |
| ***F02B 77/00*** | (2006.01) |
| *F02F 1/24* | (2006.01) |
| *F02B 75/18* | (2006.01) |

(52) U.S. Cl.
CPC . *F02B 2075/1808* (2013.01); *F02F 2001/245* (2013.01)

(56) References Cited

U.S. PATENT DOCUMENTS

| | | | | |
|---|---|---|---|---|
| 7,347,169 | B2 | 3/2008 | Nagahashi et al. | |
| 7,556,013 | B2 | 7/2009 | Negoro et al. | |
| 8,061,467 | B2 | 11/2011 | Takeshima et al. | |
| 8,448,740 | B2 | 5/2013 | Inui et al. | |
| 2005/0211485 | A1* | 9/2005 | Inui | B62J 23/00 180/69.2 |
| 2006/0213464 | A1* | 9/2006 | Tawarada | F02B 63/02 123/41.47 |
| 2007/0062467 | A1* | 3/2007 | Tanaka | F01M 11/02 123/41.31 |
| 2007/0200439 | A1* | 8/2007 | Nagahashi | F01M 1/08 310/54 |
| 2009/0127060 | A1* | 5/2009 | Ishida | B62K 11/14 192/82 R |
| 2018/0156085 | A1 | 6/2018 | Li et al. | |

FOREIGN PATENT DOCUMENTS

| | | | |
|---|---|---|---|
| CN | 101330237 | A | 12/2008 |
| CN | 201351566 | Y | 11/2009 |
| CN | 101850809 | A | 10/2010 |
| CN | 104702047 | A | 6/2015 |
| CN | 105673132 | A | 6/2016 |
| EP | 1895138 | A2 | 3/2008 |
| JP | S59-183143 | A | 10/1984 |
| JP | S61-83473 | A | 4/1986 |
| JP | H06-10666 | A | 1/1994 |
| JP | H11-229891 | A | 8/1999 |
| JP | 2007-236069 | A | 9/2007 |
| JP | 2008-056109 | A | 3/2008 |
| JP | 2008-231977 | A | 10/2008 |
| JP | 2011194969 | * | 10/2011 |
| JP | 5030473 | B2 | 9/2012 |
| WO | 2012/105308 | A1 | 8/2012 |

OTHER PUBLICATIONS

Official Communication dated Oct. 7, 2020 issued in the corresponding Japanese Patent Application No. 2019-083157.
Official Communication dated Jan. 8, 2021 issued in the corresponding Chinese Patent Application No. 201910609039.6.

* cited by examiner

ENGINE

BACKGROUND OF THE INVENTION

Field of the Invention

The present invention relates to an engine including: a crankcase; a rotary shaft that is rotatably supported on the crankcase and has protruding ends protruding to outside from the crankcase; a cover that is connected to the crankcase at a mating surface of the cover and covers the protruding end of the rotary shaft; and attachment bosses that are formed to be integral with the cover, have a predetermined height from the mating surface, and accept fastening members for fastening the cover to the crankcase.

Description of the Related Art

Japanese Patent Application Laid-open No. 2007-236069 discloses an internal combustion engine (engine) mounted on a two-wheeled motor vehicle. The engine is provided with a generator (alternating-current generator (ACG)) coupled to a protruding end of a crankshaft that protrudes from a crankcase. The ACG is covered with an ACG cover which is connected to the crankcase. Mating surfaces of the crankcase and the ACG cover are formed within a vertical plane which is orthogonal to a rotational axis of the crankshaft.

The ACG cover is integrally formed with attachment bosses that have a predetermined height from the mating surfaces and accept shaft portions of bolts for fastening the ACG cover to the crankcase. At an outer periphery of the ACG cover, a head of the bolt at each attachment boss protrudes to the outer side in the vehicle width direction. Here, in order to lower the center of gravity of the vehicle and thereby to enhance stability of the vehicle, it is desired that the engine is mounted at a position as low as possible. Protrusion of the bolts at positions near the ground surface leads to a reduction in a bank angle. Therefore, the protrusion of the bolts inhibits an arrangement of the engine at a lower position with reference to the vehicle.

SUMMARY OF THE INVENTION

The present invention has been accomplished in light of the above circumstances, and it is an object thereof to provide an engine which, when mounted on a two-wheeled motor vehicle, can restrain protrusion in the vehicle width direction and can be disposed at a position as low as possible with reference to the vehicle.

In order to achieve the object, according to a first aspect of the present invention, there is provided an engine comprising: a crankcase; a rotary shaft that is rotatably supported on the crankcase, the rotary shaft having a protruding end thereof protruding to outside from the crankcase; a cover that is connected to the crankcase at a mating surface of the cover inclined toward an inner side in a vehicle width direction in going downward when the engine is mounted to a vehicle body, the cover covering the protruding end of the rotary shaft; and attachment bosses that are formed to be integral with the cover, have a predetermined height from the mating surface, and accept fastening members for fastening the cover to the crankcase.

In accordance with the first aspect, the attachment bosses are required to have at least a predetermined height from the mating surface, in order to secure such a rigidity as to endure fastening forces of the fastening members. Since the mating surface between the crankcase and the cover is inclined toward the inner side in the vehicle width direction in going downward, the position of the attachment boss is displaced toward the inner side in the vehicle width direction in going toward the lower side of the mating surface. Therefore, when the engine is mounted on a vehicle body, protrusion of the attachment boss in the vehicle width direction is restrained in going closer to the ground surface. When mounted on a two-wheeled motor vehicle, the engine can be disposed at a position as low as possible with reference to the vehicle.

According to a second aspect of the present invention, in addition to the first aspect, the rotary shaft is a crankshaft, and the cover is a power transmission mechanism cover covering a power transmission mechanism that is fixed to the crankshaft on outside of the crankcase, the power transmission mechanism transmitting power from the crankshaft to a camshaft.

In accordance with the second aspect, the crankshaft can be disposed at a position as low as possible. Therefore, the engine can be disposed at a position as low as possible with reference to the vehicle.

According to a third aspect of the present invention, in addition to the first aspect, the rotary shaft is a crankshaft, and the cover is a generator cover covering a generator that is connected to the crankshaft on outside of the crankcase.

In accordance with the third aspect, although the generator cover is relatively large, the crankshaft can be disposed at a position as low as possible, which contributes to disposing the engine at a position as low as possible with reference to the vehicle.

According to a fourth aspect of the present invention, in addition to the third aspect, a to-be-detected body has reluctors arranged in an annular pattern coaxially with the crankshaft and detected by a pulser sensor, the to-be-detected body being fixed to the crankshaft between the generator and the crankcase, and a lower end of the mating surface is located on the inner side in the vehicle width direction further than the reluctors.

In accordance with the fourth aspect, protrusion of the generator cover is restrained. As a result, the engine can be disposed at a position as low as possible with reference to the vehicle.

According to a fifth aspect of the present invention, in addition to the fourth aspect, the pulser sensor is attached to the crankcase, the pulser sensor having an axis thereof orthogonal to a rotational axis of the crankshaft.

In accordance with the fifth aspect, the mating surface between the crankcase and the cover is inclined. Therefore, even if the pulser sensor is faced to the reluctors of the to-be-detected body in such a posture as to be orthogonal to the rotational axis of the crankshaft, the pulser sensor is supported by the crankcase.

According to a sixth aspect of the present invention, in addition to the fifth aspect, the crankcase is formed with a casing wall defining a mating surface that receives the mating surface of the generator cover at an outer end while surrounding the generator.

In accordance with the sixth aspect, the pulser sensor can be supported by the casing wall higher in rigidity than the cover, and a lowering in detection accuracy in response to vibrations of the engine can be restrained.

According to a seventh aspect of the present invention, in addition to the sixth aspect, an upper end of the mating surface is located on an outer side in the vehicle width direction further than the reluctors.

In accordance with the seventh aspect, the pulser sensor is faced to the reluctors at the outer periphery of the to-be-detected body. Therefore, the pulser sensor is supported by the casing wall higher in rigidity than the cover.

According to an eighth aspect of the present invention, in addition to the seventh aspect, the pulser sensor is attached above a horizontal plane containing the rotational axis of the crankshaft.

In accordance with the eighth aspect, protrusion amount of the casing wall is large above the horizontal plane containing the rotational axis of the crankshaft, in the crankcase. Therefore, with pulser sensor attached above the horizontal plane, the pulser sensor can be supported by the casing wall higher in rigidity than the cover, and a lowering in detection accuracy in response to vibrations of the engine can be restrained.

According to a ninth aspect of the present invention, in addition to the first aspect, there is provided the engine, further comprising a plurality of knock pins that are embedded in the crankcase and the cover while crossing the mating surface, and position the cover relative to the crankcase along the mating surface, wherein when a direction of a connecting force of the fastening member is inclined relative to a perpendicular line orthogonal to the mating surface, at least one of knock pins located on the outer side in the vehicle width direction, out of the plurality of knock pins, has an embedment amount into the cover larger than those of other knock pins.

In accordance with the ninth aspect, when the connecting force acts on the cover in the direction toward the crankcase, the direction of the connecting force of the fastening member is inclined relative to the perpendicular line orthogonal to the mating surface, and, therefore, a force for shifting in parallel to the mating surface acts on the cover. The shifting force is positively supported by the knock pin located on the outer side in the vehicle width direction. As a result, it is possible to reduce concentration of stress locally generated in the cover by the actions of the knock pins. The strength of the cover can be enhanced by only controlling the embedment amount of the knock pins.

According to a tenth aspect of the present invention, in addition to the ninth aspect, the fastening member is a bolt having an axis orthogonal to a center plane in a left-right direction of the vehicle body.

In accordance with the tenth aspect, the bolt has an axis orthogonal to the center plane in the left-right direction of the vehicle, and, therefore, the design of the vehicle can be kept favorable when the engine is mounted onto the vehicle body.

According to an eleventh aspect of the present invention, in addition to the ninth or tenth aspect, the plurality of knock pins have a same length.

In accordance with the eleventh aspect, the plurality of knock pins have the same length, and, therefore, management of manufacture can be simplified.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be described below, referring to the attached drawings. Here, the up, down, front, rear, left and right directions of a vehicle body are defined based on the gaze of a rider riding on a two-wheeled motor vehicle.

Figure 1:
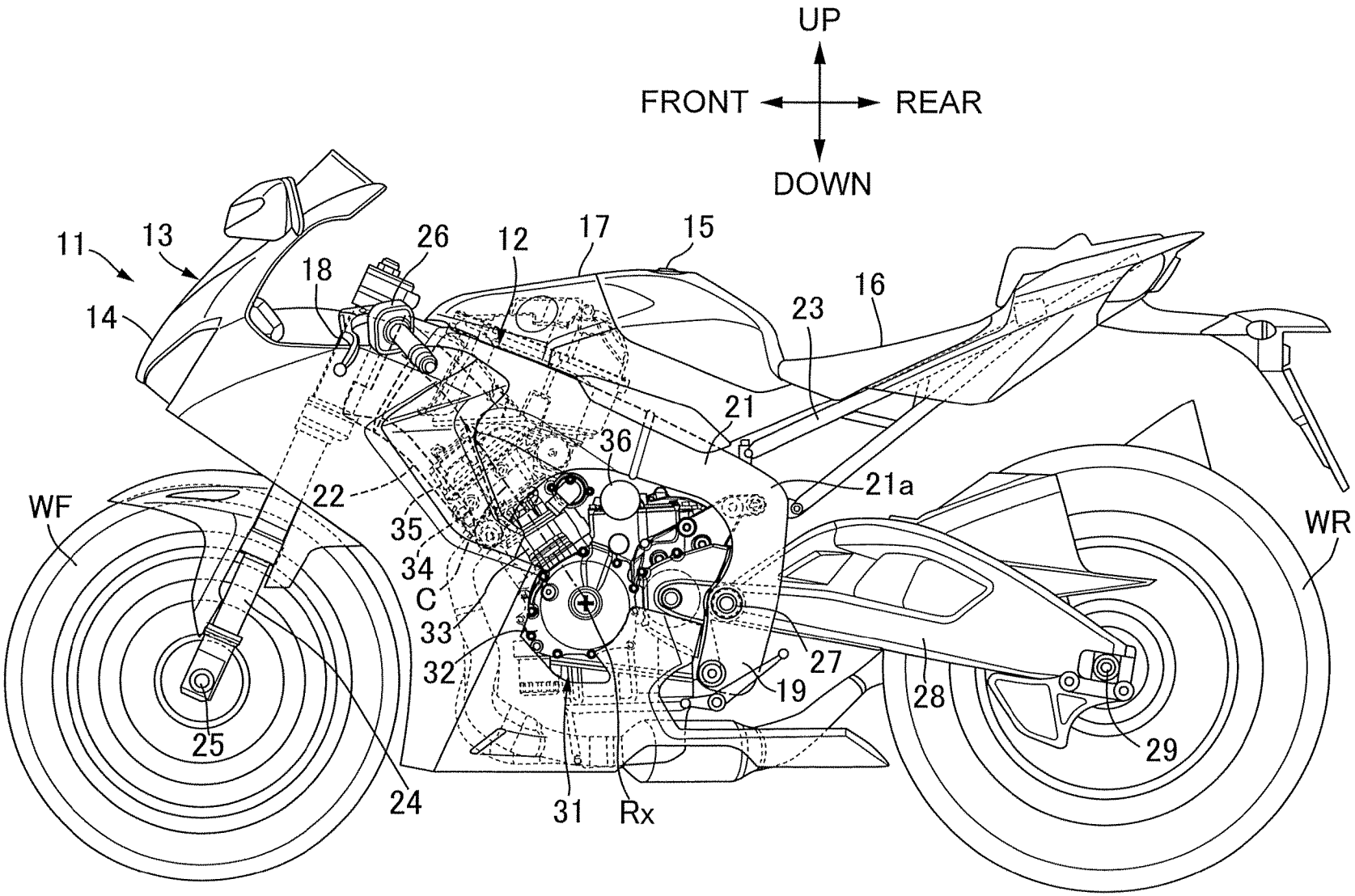
FIG. 1 is a side view schematically depicting a whole configuration of a two-wheeled motor vehicle according to an embodiment.

FIG. 1 schematically depicts a whole image of a two-wheeled motor vehicle which is a saddle-ridden vehicle according to an embodiment of the present invention. The two-wheeled motor vehicle 11 includes a body frame 12, and a body cover 13 mounted to the body frame 12. The body cover 13 includes a front cowl 14 covering the body frame 12 from the front side, and a tank cover 17 that is forwardly continuing from an outer surface of a fuel tank 15 and is connected to a rider seat 16 on the rear side of the fuel tank 15. A fuel is reserved in the fuel tank 15. A rider straddles a rider seat 16 when operating the two-wheeled motor vehicle 11.

The body frame 12 includes: a head pipe 18; a pair of left and right main frames 21 that extend rearwardly downward from the head pipe 18 and have pivot frames 19 at rear lower ends thereof; a down frame 22 that extends downward from the head pipe 18 at a position on the lower side of the main frames 21 and is united to the main frames 21; and left and right seat frames 23 that extend rearwardly upward from curved regions 21*a* of the main frames 21 and constitute a truss structure. The seat frames 23 support the rider seat 16.

A front fork 24 is steerably supported on the head pipe 18. A front wheel WF is supported on the front fork 24 such as to be rotatable around an axle 25. A steering handlebar 26 is connected to an upper end of the front fork 24. The driver holds grips at left and right ends of the steering handlebar 26 when driving the two-wheeled motor vehicle 11.

A swing arm 28 is connected to the body frame 12 on a rear side in the vehicle such as to be swingable in the up-down direction around a pivot 27. A rear wheel WR is supported at a rear end of the swing arm 28 such as to be rotatable around an axle 29. An engine 31 for generating a driving force transmitted to the rear wheel WR is mounted on the body frame 12 between the front wheel WF and the rear wheel WR. The power of the engine 31 is transmitted to the rear wheel WR through a transmission system.

The engine 31 includes: a crankcase 32 that is disposed between the down frame 22 and the main frames 21, is connected to and supported by the down frame 22 and the main frames 21, and outputs power around a rotational axis Rx; a cylinder block 33 that is connected to the crankcase 32 and has a cylinder axis C located within a vertical plane orthogonal to the rotational axis Rx and rising relative to a horizontal plane; a cylinder head 34 that is connected to an upper end of the cylinder block 33 and supports a valve train; and a head cover 35 that is connected to an upper end of the cylinder head 34 and covers the valve train over the cylinder head 34.

The two-wheeled motor vehicle 11 has a canister 36 which reserves an evaporated fuel gas generated from the fuel tank 15. The canister 36 is disposed below the fuel tank 15, above the crankcase 32 and on the back side of the cylinder block 33, and is connected to the fuel tank 15. The canister 36 has a tube body which has a center axis in the vehicle width direction parallel to the rotational axis Rx, and defines a space for accommodating activated carbon. Therefore, the canister 36 is cylindrical in outer shape.

Figure 2:
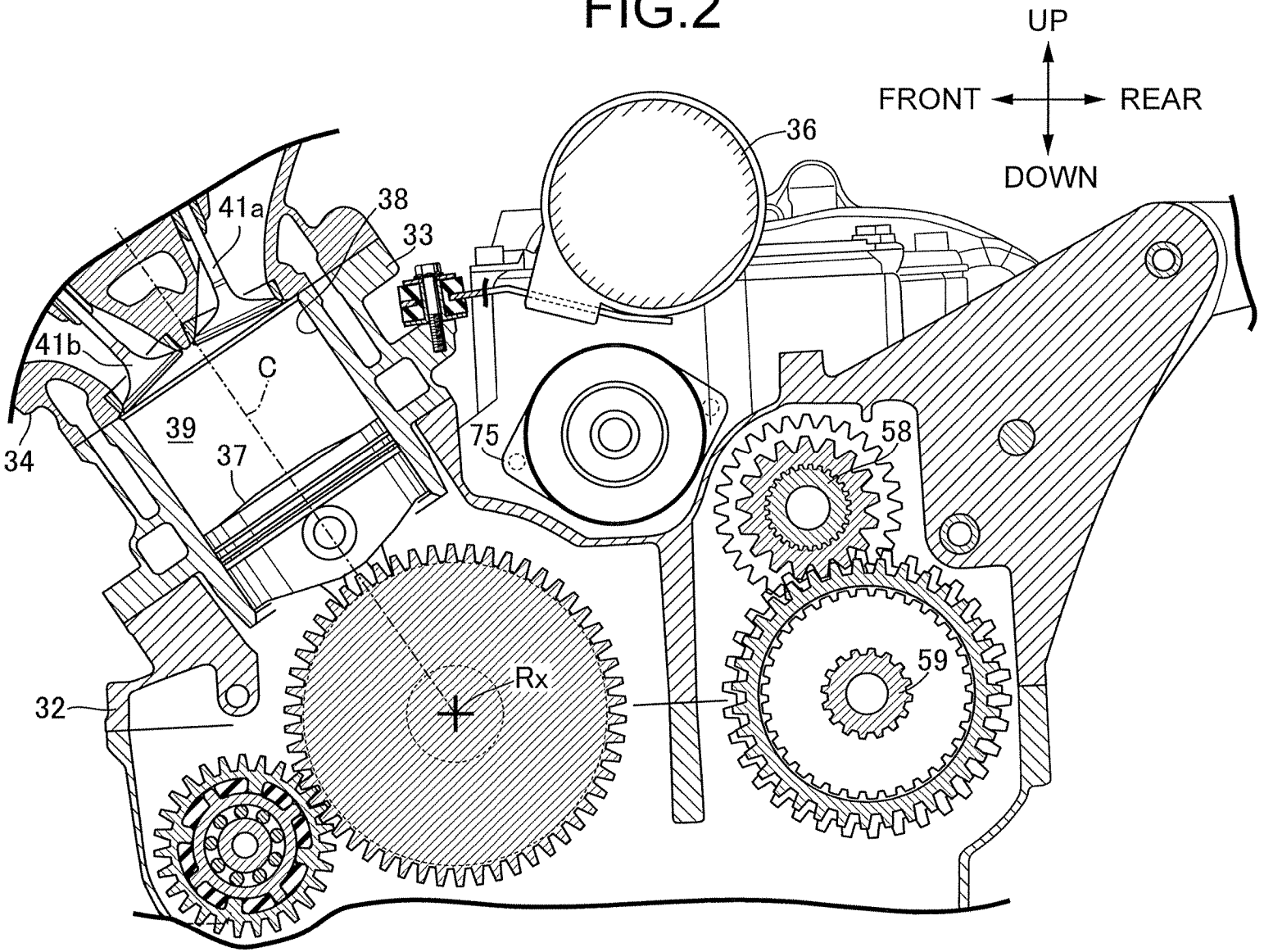
FIG. 2 is an enlarged side view observed in a vertical section, schematically depicting the surroundings of an engine.

As depicted in FIG. 2, the cylinder block 33 is formed therein with cylinder 38 each guiding a linear reciprocating motion of a piston 37 along a cylinder axis C. Here, the engine 31 is configured in a so-called in-line four-cylinder engine, in which four cylinders 38 are arranged along the rotational axis Rx in the cylinder block 33. A combustion chamber 39 is defined between the piston 37 and the cylinder head 34. By the functions of an intake valve 41*a* and an exhaust valve 41*b* opened and closed according to the rotation of a camshaft, an air-fuel mixture is introduced into the combustion chamber 39, and an exhaust gas after combustion is exhausted from the combustion chamber 39.

Figure 3:
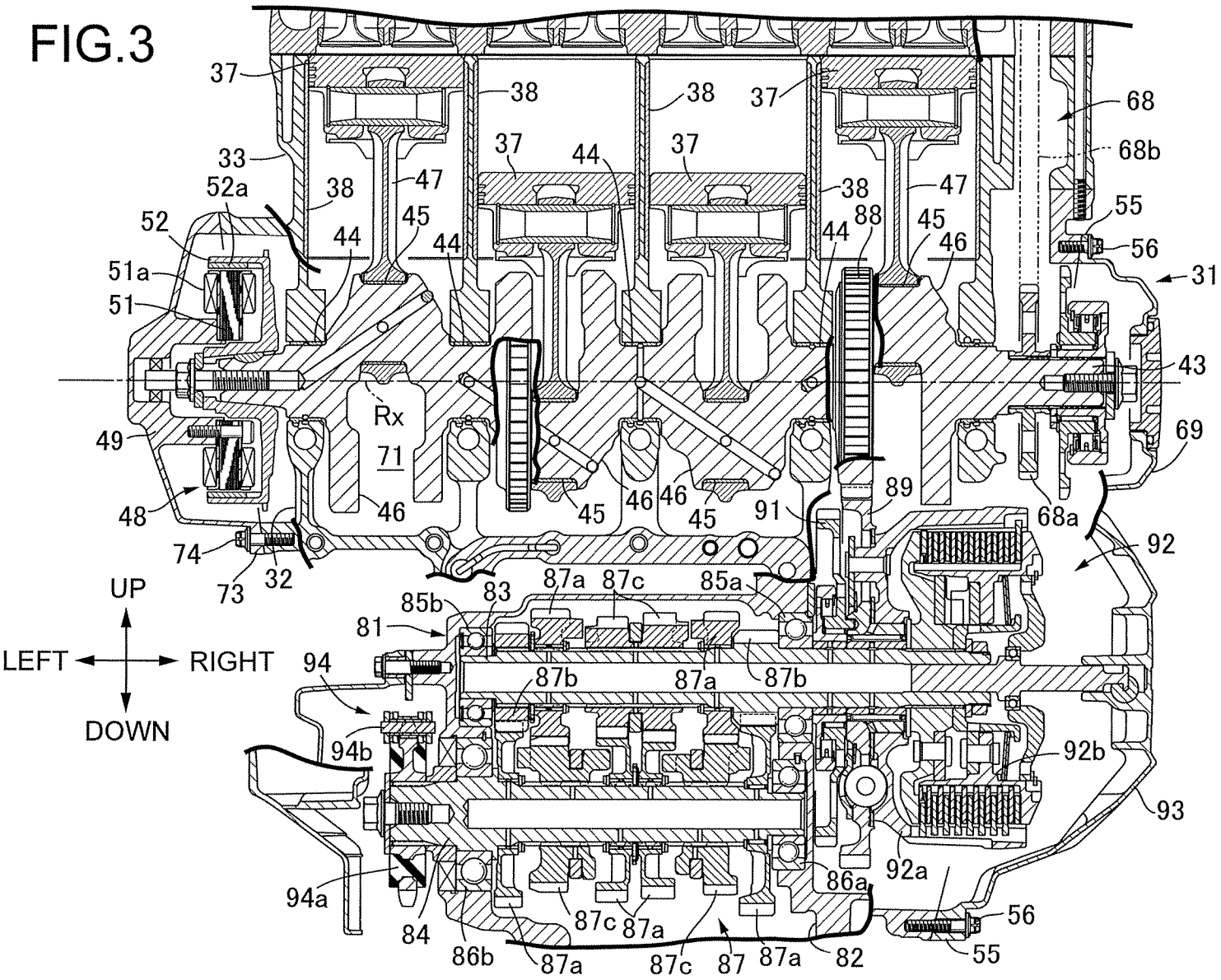
FIG. 3 is an enlarged sectional view schematically depicting the structure observed in a section containing a rotational axis of a crankshaft and axes of a main shaft and a counter shaft.

As illustrated in FIG. 3, a crankshaft 43 (as rotary shaft) is supported in the crankcase 32 such as to be rotatable around the rotational axis Rx. The crankshaft 43 includes journals 44 which are connected to plain bearings, and cranks 46 each of which is disposed between the adjacent journals 44, extends in parallel to the rotational axis Rx, and has a crank pin 45 interconnecting crank webs. A large end portion of a connecting rod 47 extending from the piston 37 is rotatably connected to the crank pin 45. The connecting rod 47 converts a linear reciprocating motion of the piston 37 into a rotational motion of the crankshaft 43.

One end of the crankshaft 43 protrudes to the outside from a left side surface of the crankcase 32. An ACG (alternating-current generator) 48 (as generator) is connected to the one end of the crankshaft 43. An ACG cover 49 for accommodating the ACG 48 between itself and the crankcase 32 is connected to the left side surface of the crankcase 32. The ACG 48 includes a stator 51 which is fixed to the ACG cover 49, and a rotor 52 which is connected, in a relatively non-rotatable manner, to the one end of the crankshaft 43 protruding from the crankcase 32. The stator 51 has a plurality of coils 51*a* which are aligned in the peripheral direction around the crankshaft 43 and are wound around a stator core. The rotor 52 has a plurality of magnets 52*a* which are aligned in the peripheral direction along an annular trajectory surrounding the stator 51. When the crankshaft 43 rotates, the magnets 52*a* are displaced relative to the coils 51*a*, whereby the ACG 48 generates electric power.

Figure 4:
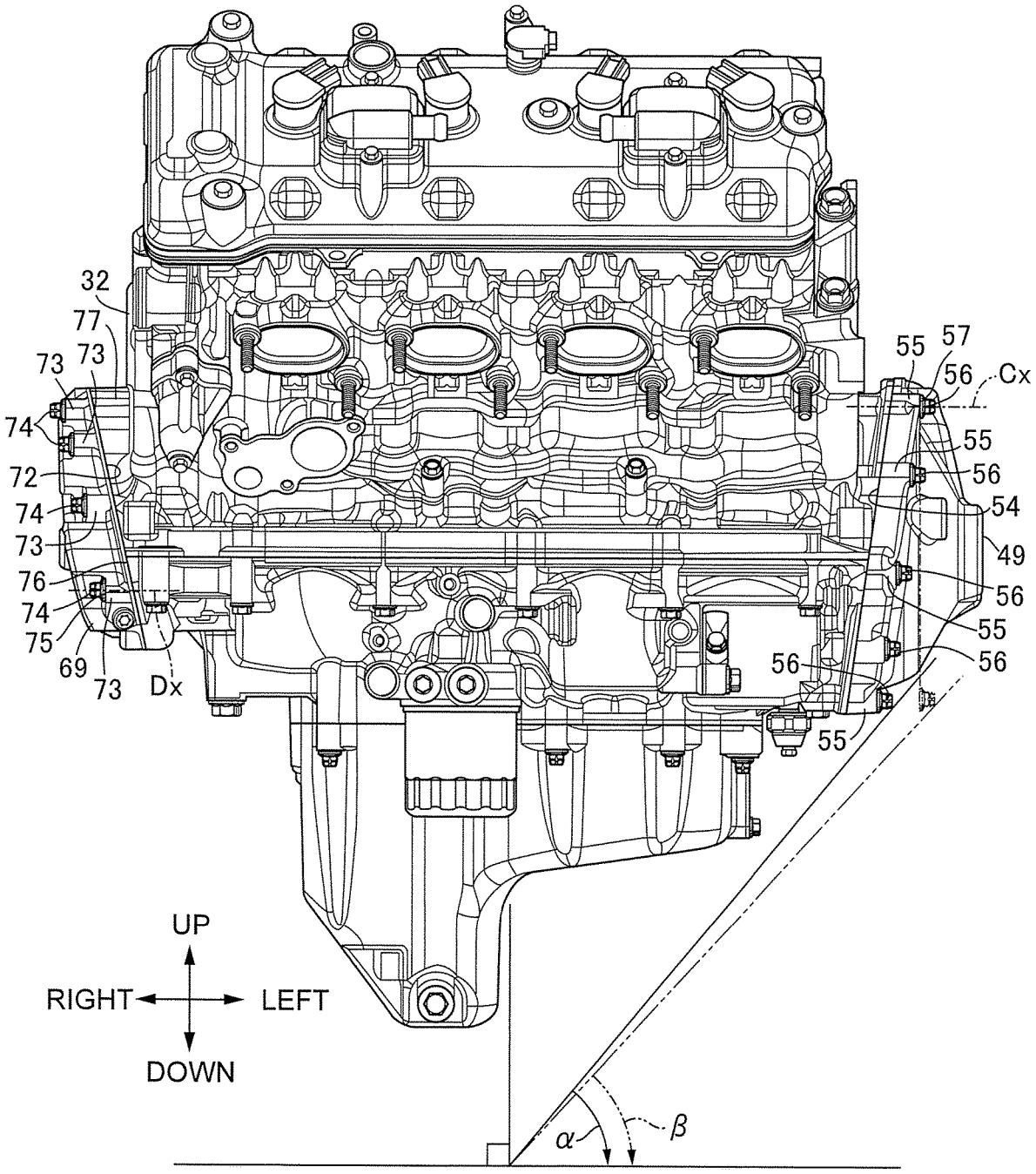
FIG. 4 is an enlarged front view of the engine.

As depicted in FIG. 4, the ACG cover 49 is connected to the crankcase 32 at a mating surface 54 which is inclined to the inner side in the vehicle width direction in going downward. Attachment bosses 55 having a predetermined height in the horizontal direction from the mating surface 54 are integrally formed on an outer periphery of the ACG cover 49. The attachment boss 55 is formed therein with a through-hole for accepting a shaft portion of a bolt 56 as a fastening member. A center axis Cx of the through-hole is set in parallel to the rotational axis Rx of the crankshaft 43. The attachment boss 55 is formed at an outer end thereof with a bearing surface 57 for receiving a head portion of the bolt 56, orthogonally to the center axis Cx of the through-hole. The height of the attachment boss 55 corresponds to the length of the center axis Cx as measured between the mating surface 54 and the bearing surface 57. The crankcase 32 is formed with tapped holes into which the shaft portions of the bolts 56 are screwed, continuously from the through-holes of the attachment bosses 55.

Figure 5:
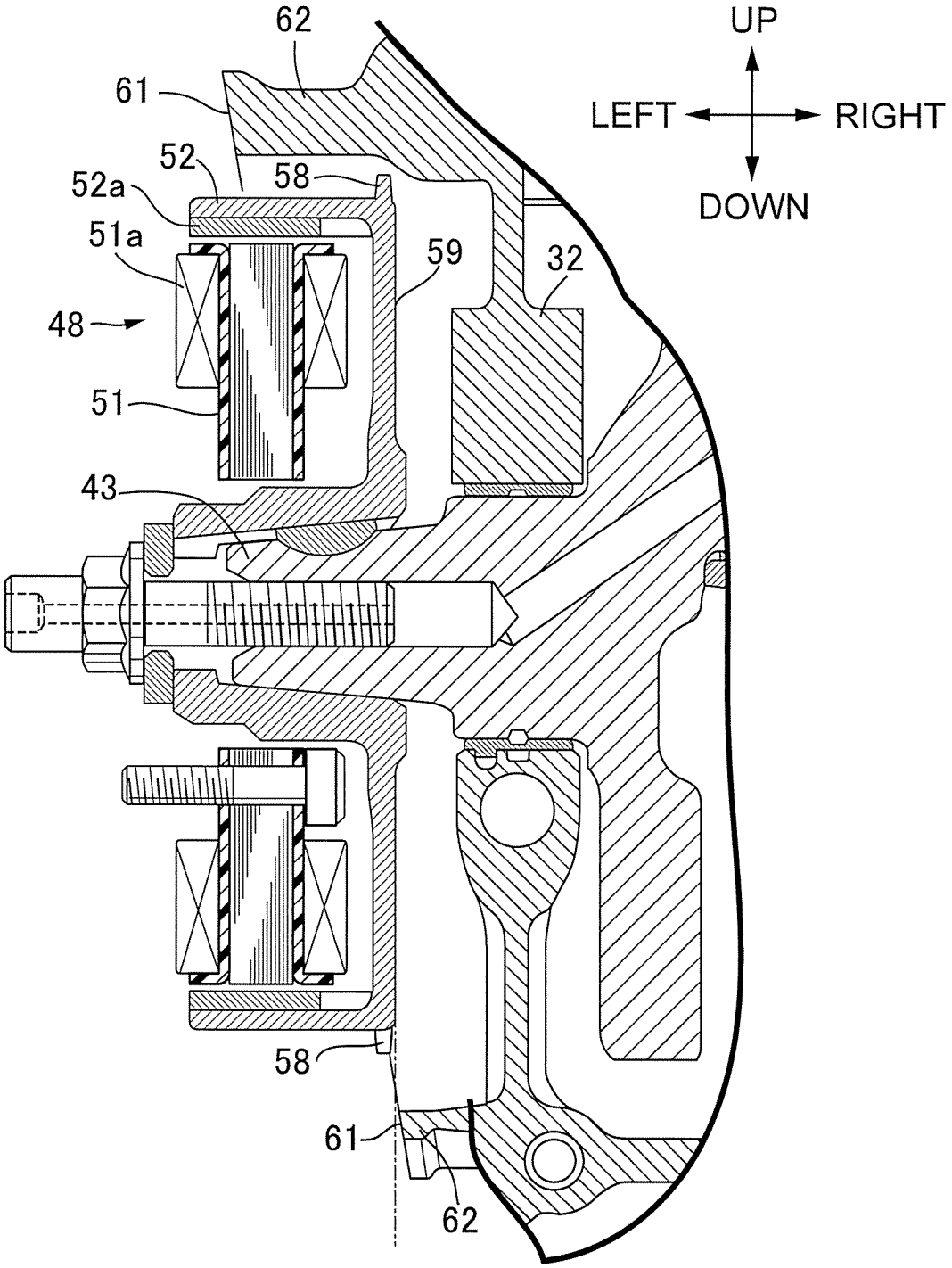
FIG. 5 is an enlarged partial sectional view of the engine cut in a vertical plan.

As illustrated in FIG. 5, a pulser ring (to-be-detected body) 59 having reluctors 58 disposed in an annular pattern coaxially with the crankshaft 43 is attached to the crankshaft 43, between the rotor 52 of the ACG 48 and the crankcase 32. The pulser ring 59 is, for example, fixed (united) to the rotor 52 of the ACG 48. The reluctors 58 protrude radially outward beyond an outer periphery of the rotor 52. The pulser ring 59 is formed from a magnetic material, for example. The crankcase 32 is formed with a casing wall 62 defining a mating surface 61, which receives the mating surface 54 of the ACG cover 49, at an outer end while surrounding the ACG 48. Lower ends of the mating surfaces 54, 61 are located on the inner side in the vehicle width direction further than the reluctors 58.

Figure 6:
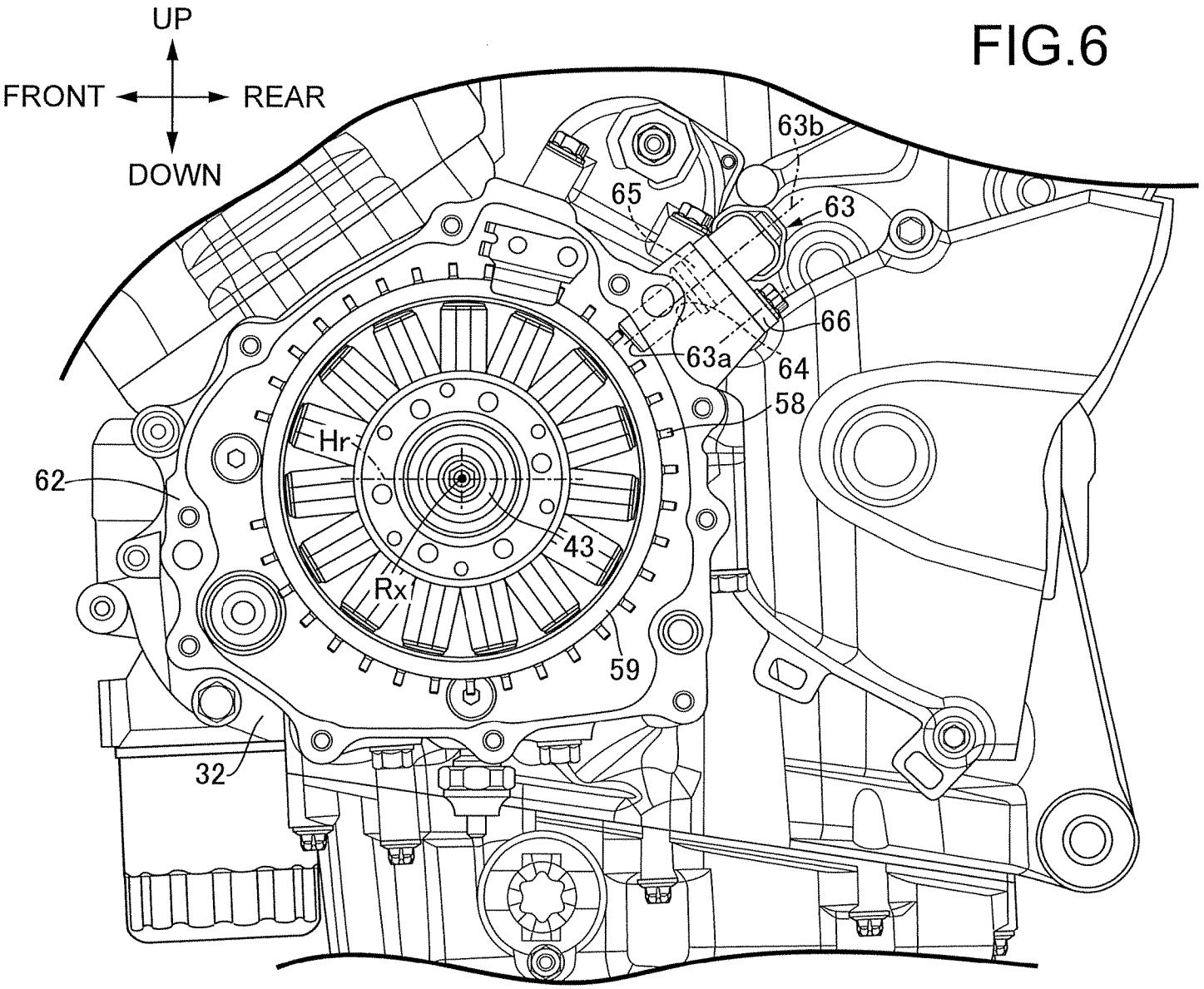
FIG. 6 is an enlarged side view of a state in which a generator (ACG) cover has been detached.

As depicted in FIG. 6, a pulser sensor 63 which is faced to the trajectory of the reluctors 58 at a detection end 63*a* and generates a pulse signal according to the movement of the reluctors 58 is attached to the casing wall 62 of the crankcase 32. The pulser sensor 63 includes: a sensor main body 65 having the detection end 63*a* which is inserted from outside into a sensor hole 64 bored in the casing wall 62 above a horizontal plane Hr containing the rotational axis Rx of the crankshaft 43 and faces a space on the inside of the casing wall 62; and an attachment piece 66 which is connected to the sensor main body 65, is laid over an outer surface of the casing wall 62 on the outside of the sensor hole 64 and is fastened to the casing wall 62.

The detection end 63*a* of the pulser sensor 63 is faced to the trajectory of the reluctors 58 which are arranged at regular intervals along a plane orthogonal to the rotational axis Rx of the crankshaft 43. The pulser sensor 63 outputs an electrical signal, that is, a pulse signal, according to the presence or absence of a magnetic body which is detected on the trajectory of the reluctors 58, by the function of a magnetoresistance effect element, for example. By the pulse signal, an angular position of the crankshaft 43 is specified. An angular velocity of the crankshaft 43 is calculated based on the information of the pulse signal, and misfire detection can be judged. In the pulser sensor 63, a detection axis 63*b* having the highest sensitivity is oriented to the rotational axis Rx.

As illustrated in FIG. 3, the other end of the crankshaft 43 protrudes to the outside from a right side wall of the crankcase 32. A valve train (power transmission mechanism) 68 that transmits power to the camshaft is connected to the other end of the crankshaft 43. The valve train 68 includes: a driving cam gear 68*a* coaxially fixed to the crankshaft 43; a driven cam gear (not depicted) fixed to the camshaft; and a cam gear train 68*b* composed of a plurality of gears which are sequentially meshed together ranging from the driving cam gear 68*a* to the driven cam gear and transmits power from the driving cam gear 68*a* to the driven cam gear. A valve train cover 69 (as cover) that accommodates the driving cam gear 68*a* between itself and the crankcase 32 is connected to the right side surface of the crankcase 32. The ACG cover 49 and the valve train cover 69 are put over the outer surface of the crankcase 32, to define a crank chamber 71 in which the crankshaft 43 is accommodated. The valve train 68 may include a driving sprocket, a driven sprocket and a cam chain, in place of the driving cam gear 68*a*, the driven cam gear and the cam gear train 68*b*.

As depicted in FIG. 4, the valve train cover 69 is connected to the crankcase 32 at a mating surface 72 which is inclined to the inner side in the vehicle width direction in going downward. Attachment bosses 73 having a predetermined height in the horizontal direction from the mating surface 72 are integrally formed at an outer periphery of the valve train cover 69. The attachment boss 73 is formed therein with a through-hole that accepts a shaft portion of a bolt 74 as a fastening member. A center axis Dx of the through-hole is set in parallel to the rotational axis Rx of the crankshaft 43. The attachment boss 73 is formed at an outer end thereof with a bearing surface 75 that receives a head portion of the bolts 74, orthogonally to the center axis Dx of the through-hole. The height of the attachment boss 73 corresponds to the length of the center axis Dx as measured between the mating surface 72 and the bearing surface 75. The crankcase 32 is formed with a casing wall 77 defining a mating surface 76, that receives the mating surface 72 of the valve train cover 69, at an outer end while surrounding the driving cam gear 68*a* partly. The casing wall 77 is formed therein with tapped holes into which shaft portions of the bolts 74 are screwed, continuously from the through-holes of the attachment bosses 73.

As illustrated in FIG. 3, a dog clutch type multistage transmission (hereinafter referred to as "transmission") 81 is incorporated into the engine 31. The transmission 81 is accommodated in a transmission chamber 82 defined in the crankcase 32 continuously from the crank chamber 71. The transmission 81 includes a main shaft 83 and a counter shaft 84, each of which has an axis parallel to the axis of the crankshaft 43. The main shaft 83 and the counter shaft 84 are rotatably supported on the crankcase 32 through rolling bearings 85*a*, 85*b*, 86*a* and 86*b*.

A plurality of transmission gears 87 are supported on the main shaft 83 and the counter shaft 84. The transmission gears 87 are accommodated in the transmission chamber 82 in the state of being disposed between the bearings 85*a*, 85*b*; 86*a*, 86*b*. The transmission gears 87 include: rotating gears 87*a* which are coaxially and relatively rotatably supported on the main shaft 83 or the counter shaft 84; fixed gears 87*b* which are relatively non-rotatably fixed to the main shaft 83 and mesh with the corresponding rotating gears 87*a*; and shift gears 87*c* which are relatively non-rotatably and axially displaceably supported on the main shaft 83 or the counter shaft 84 and mesh with the corresponding rotating gear 87*a*. The axial displacements of the rotating gear 87*a* and the fixed gears 87*b* are restrained. When the shift gear 87*c* is coupled to the rotating gear 87*a* through axial displacement, relative rotation between the rotating gear 87*a* and the main shaft 83 or the counter shaft 84 is restrained. When the shift gear 87*c* meshes with the fixed gear 87*b* on the other shaft, rotating power is transmitted between the main shaft 83 and the counter shaft 84. When the shift gear 87*c* is coupled to the rotating gear 87*a* meshing with the fixed gear 87*b* on the other shaft, rotating power is transmitted between the main shaft 83 and the counter shaft 84. In this way, with the specific ones of the transmission gears 87 meshed with each other between the main shaft 83 and the counter shaft 84, rotating power is transmitted from the main shaft 83 to the counter shaft 84 at a prescribed speed reducing ratio.

One end of the main shaft 83 protrudes to the outside from a right side surface of the crankcase 32. A primary driven gear 89 meshing with a primary driving gear 88 on the crankshaft 43 and a one-way clutch gear 91 coupled to the primary driven gear 89 are relatively rotatably and coaxially supported on the one end of the main shaft 83, on the outside of the crankcase 32. The primary driving gear 88 is, for example, formed to be integral with the crank 46 of the crankshaft 43. The one-way clutch 91 applies a rotating force to the primary driven gear 89 when rotating in one direction according to an external force acting from gear teeth, and rotates relatively to the primary driven gear 89, to keep a stationary state on the main shaft 83, when the primary driven gear 89 rotates according to a driving force from the crankshaft 43.

A friction clutch 92 is coupled to the primary driven gear 89 on the main shaft 83. A clutch cover 93 that accommodates the friction clutch 92 between itself and the crankcase 32 is connected to the right side surface of the crankcase 32. The friction clutch 92 includes a clutch outer 92*a* and a clutch hub 92*b*. The primary driven gear 89 is coupled to the clutch outer 92*a*. According to an operation of a clutch lever, engagement and disengagement between the clutch outer 92*a* and the clutch hub 92*b* are switched in the friction clutch 92.

A driving sprocket 94*a* of a transmission device 94 disposed on the outside of the crankcase 32 is connected to the counter shaft 84. A driving chain 94*b* is wrapped around the driving sprocket 94*a*. The driving chain 94*b* transmits rotating power of the driving sprocket 94*a* to the rear wheel WR.

An operation of the present embodiment will be described below. While the two-wheeled motor vehicle 11 is traveling, at the time of turning to the left or right the rider moves the body weight to in the left-right direction of the vehicle, thereby to tilt the vehicle at a specific bank angle and stabilize the posture of the vehicle. In this instance, as depicted in FIG. 4, at least a bank angle $\alpha$ is secured at the engine 31 of the two-wheeled motor vehicle 11. This bank angle $\alpha$ is greater than a bank angle $\beta$ established when the mating surfaces 54 and 61 of the crankcase 32 and the ACG cover 49 are defined within a vertical plane.

The attachment bosses 73 of the valve train cover 69 are required to have at least a predetermined height from the mating surface 72, for securing such a rigidity as to endure fastening forces of the bolts 74. With the mating surfaces 72 and 76 of the crankcase 32 and the valve train cover 69 inclined to the inner side in the vehicle width direction in going downward as in the present embodiment, the position of the attachment boss 73 is displaced toward the inner side in the vehicle width direction in going toward the lower side of the mating surfaces 72 and 76. Therefore, in the two-wheeled motor vehicle 11, protrusion of the attachment boss 73 in the vehicle width direction is restrained in going closer to the ground surface. In this way, the crankshaft 43 can be disposed at a position as low as possible. The engine 31 is disposed at a position as low as possible with reference to the vehicle.

Similarly, the attachment bosses 55 of the ACG cover 49 are required to have at least a predetermined height from the mating surface 54, for securing such a rigidity as to endure fastening forces of the bolts 56. With the mating surfaces 54 and 61 between the crankcase 32 and the ACG cover 49 inclined to the inner side in the vehicle width direction in going downward, the position of the attachment boss 55 is displaced toward the inner side in the vehicle width direction in going toward the lower side of the mating surfaces 54 and 61. Therefore, in the two-wheeled motor vehicle 11, protrusion of the attachment boss 55 in the vehicle width direction is restrained in going closer to the ground surface. In this way, the crankshaft 43 can be disposed at a position as low as possible. The engine 31 is disposed at a position as low as possible with reference to the vehicle.

In the present embodiment, the pulser ring 59 is fixed to the crankshaft 43 between the ACG 48 and the crankcase 32. The pulser ring 59 has the reluctors 58 arranged in an annular pattern coaxially with the crankshaft 43. Lower ends of the mating surfaces 54 and 61 between the ACG cover 49 and the crankcase 32 are located on the inner side in the vehicle width direction further than the reluctors 58. In this way, protrusion of the ACG cover 49 is restrained, resulting in that the engine 31 can be disposed at a position as low as possible with reference to the vehicle.

The pulser sensor 63 is attached to the casing wall 62 of the crankcase 32, with its axis orthogonal to the rotational axis Rx of the crankshaft 43. Since the mating surfaces 54 and 61 between the crankcase 32 and the ACG cover 49 are inclined, it is ensured that even if the pulser sensor 63 is faced to the reluctors 58 of the pulser ring 59 in a posture of being orthogonal to the rotational axis Rx of the crankshaft 43, the pulser sensor 63 is supported not by the ACG cover 49 but by the casing wall 62 of the crankcase 32.

The crankcase 32 is formed with the casing wall 62 defining the mating surface 61, that receives the mating surface 54 of the ACG cover 49, at an outer end while surrounding the ACG 48. The pulser sensor 63 can be supported on the casing wall 62 which is higher in rigidity than the ACG cover 49, and a lowering in detection accuracy in response to vibrations of the engine 31 is restrained. In this instance, upper ends of the mating surfaces 54 and 61 are located on the outer side in the vehicle width direction further than the reluctors 58. Since the pulser sensor 63 is faced to the reluctors 58 at the outer periphery of the pulser ring 59, the pulser sensor 63 can be supported by the casing wall 62 which is higher in rigidity than the ACG cover 49.

In the present embodiment, the pulser sensor 63 is attached above the horizontal plane Hr containing the rotational axis Rx of the crankshaft 43. Since the protrusion amount of the casing wall 62 is large above the horizontal plane Hr containing the rotational axis Rx of the crankshaft 43, in the crankcase 32, the configuration in which the pulser sensor 63 is attached above the horizontal plane Hr ensures that the pulser sensor 63 can be supported by the casing wall 62 which is higher in rigidity than the ACG cover 49, and a lowering in detection accuracy in response to vibrations of the engine 31 is restrained.

Figure 7:
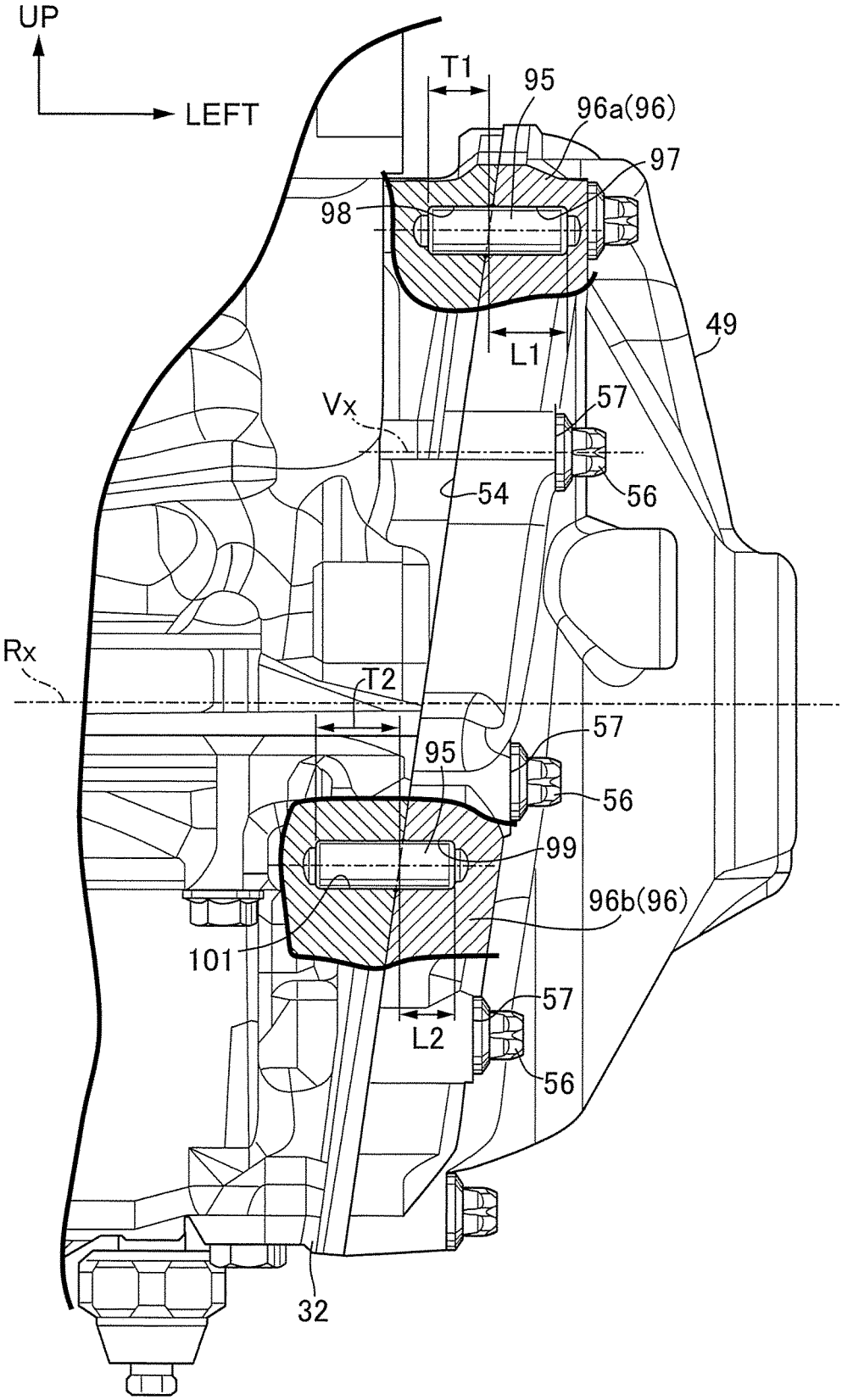
FIG. 7 is an enlarged sectional view schematically depicting knock pins fitted into the ACG cover.

As depicted in FIG. 7, the engine 31 includes a plurality of knock pins 95 that are embedded in the crankcase 32 and the ACG cover 49 while crossing the mating surface 54, and position the ACG cover 49 relative to the crankcase 32 along the mating surface 54. The knock pins 95 are each formed of a cylindrical body having an axis parallel to the rotational axis Rx of the crankshaft 43. The ACG cover 49 is integrally formed, in its outer periphery, with a plurality of knock pin bosses 96 for accommodating the knock pins 95. The knock pin bosses 96 include a first knock pin boss 96*a* disposed at an upper most position, and a second knock pin boss 96*b* disposed below the first knock pin boss 96*a*. The first knock pin boss 96*a* is formed with a first receiving hole 97 opening in the mating surface 54. The first receiving hole 97 defines a cylindrical space coaxial with and equal in diameter to the knock pin 95. The knock pin 95 is fitted into the first receiving hole 97 with a first embedment amount L1. The embedment amount is specified by the length of a center axis of the knock pin entering the receiving hole.

The crankcase 32 is formed therein with a first insertion hole 98 continuous from the first receiving hole 97 of the first knock pin boss 96*a*. The knock pin 95 is inserted into the first insertion hole 98 with a first insertion amount T1. The insertion amount is specified by the length of a center axis of the knock pin 95 entering the insertion hole. The length of the knock pin 95 is specified by the sum of the first embedment amount L1 and the first insertion amount T1.

The second knock pin boss 96*b* is formed with a second receiving hole 99. The knock pin 95 is fitted into the second receiving hole 99 with a second embedment amount L2 which is smaller than the first embedment amount L1. The knock pin 95 is formed of a cylindrical body having an axis parallel to the rotational axis Rx of the crankshaft 43. The second receiving hole 99 defines a cylindrical space coaxial with and equal in diameter to the knock pin 95.

The crankcase 32 is formed therein with a second insertion hole 101 continuous from the second receiving hole 99 of the second knock pin boss 96*b*. The knock pin 95 is inserted into the second insertion hole 101 with a second insertion amount T2 which is larger than the first insertion amount T1. As the knock pins 95, knock pins having a common length are used (that is, L1+T1=L2+T2).

Since the bolt 56 has an axis Vx orthogonal to the center plane in the left-right direction of the vehicle body, it produces a connecting force acting on the ACG cover 49 in a direction orthogonal to the center plane in the left-right direction of the vehicle body. Here, the center plane in the left-right direction of the vehicle body corresponds to an imaginary plane which is orthogonal to the rotational axis of the rear wheel WR and which contains the center axis of the head pipe 18. When the bolt 56 is screwed into the crankcase 32, a force for shifting in parallel to the mating surface 54 acts on the ACG cover 49. The shifting force is positively supported by the knock pin 95 located on the outer side in the vehicle width direction. As a result, concentration of stress locally generated in the ACG cover 49 by the actions of the knock pins 95 is reduced. The strength of the ACG cover 49 is enhanced by only controlling the embedment amounts of the knock pins 95. In this instance, since the bolts 56 each have the axis Vx orthogonal to the center plane in the left-right direction of the vehicle body, bearing surfaces 57 are aligned in parallel to the center plane in the left-right direction of the vehicle body, and the design of the vehicle is kept favorable. Since the plurality of the knock pins 95 have a common length, management of manufacture can be simplified.

Figure 8:
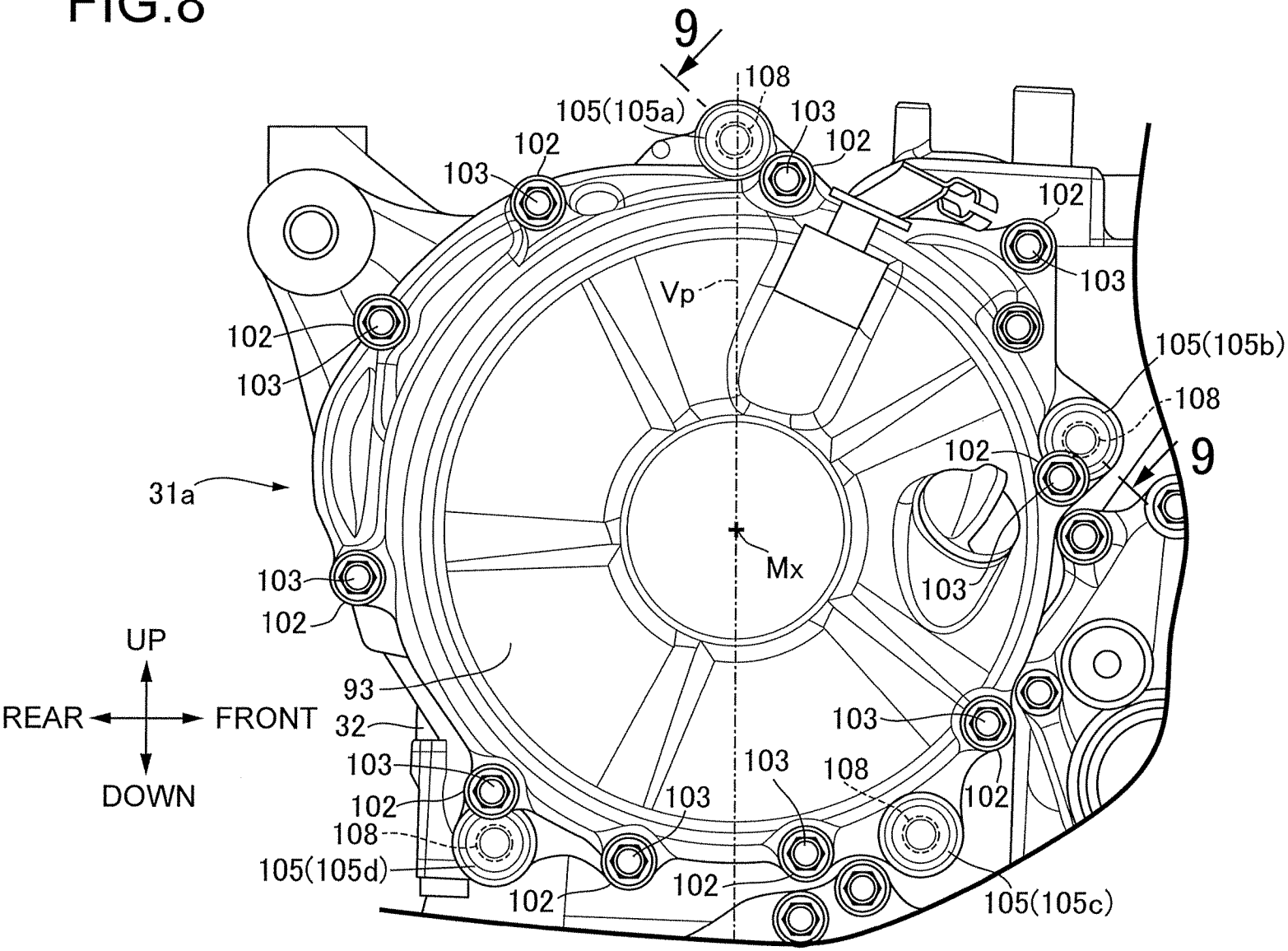
FIG. 8 is an enlarge side view of the engine, schematically depicting a clutch cover.
Figure 9:
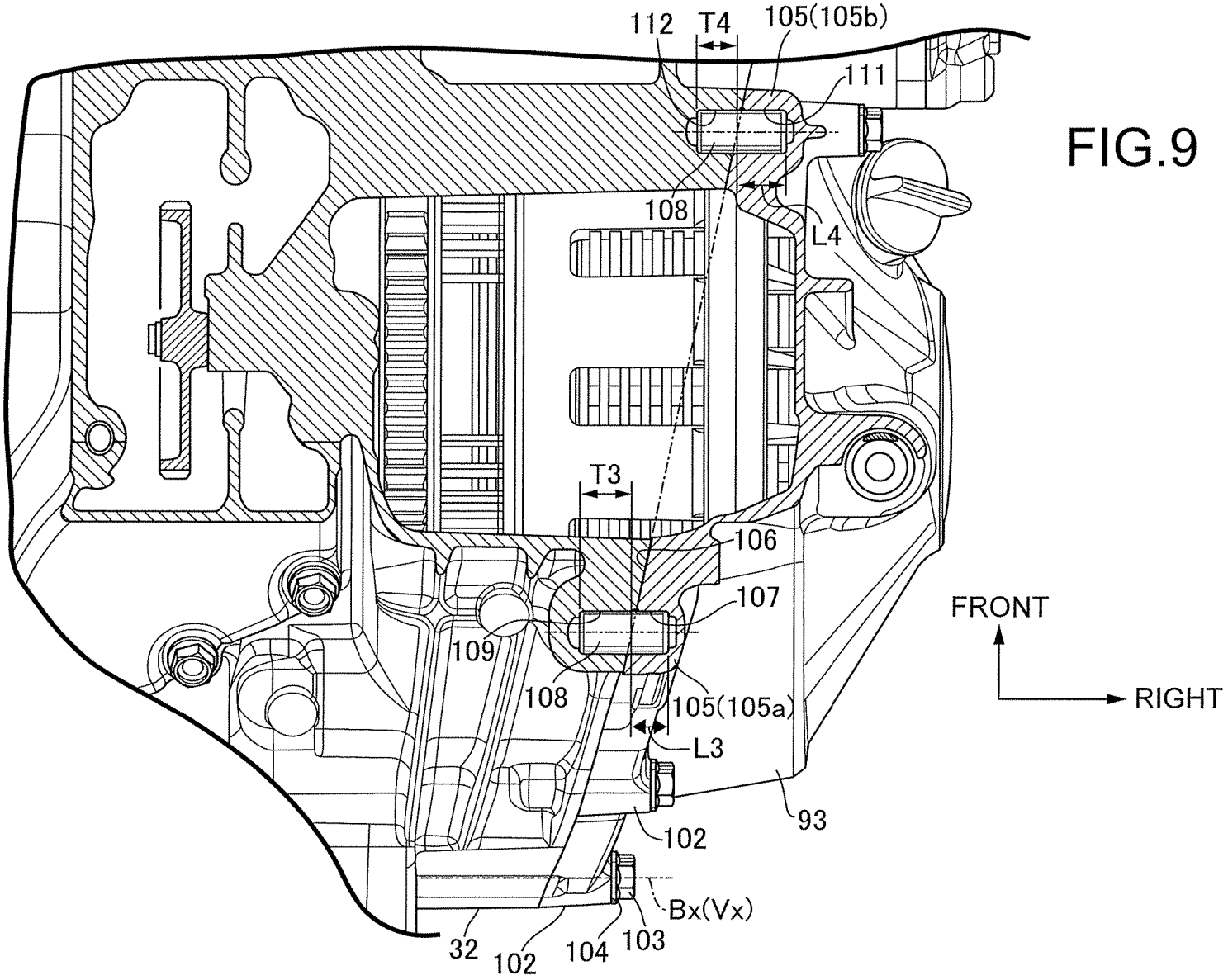
FIG. 9 is an enlarged sectional view of a clutch cover cut in a section passing through the axes of a first knock pin boss and a second knock pin boss, corresponding to a sectional view taken along line 9-9 of FIG. 8.

FIG. 8 is a side view of an engine 31*a* including a clutch cover 93 according to a modification of the present invention. The clutch cover 93 covers a protruding end of a main shaft 83 protruding from the crankcase 32 to the outside. The clutch cover 93 is integrally formed, at its outer periphery, with attachment bosses 102 having a predetermined height in a horizontal direction. The attachment boss 102 is formed therein with a through-hole for accepting a shaft portion of a bolt 103 serving as a fastening member. As depicted in FIG. 9, a center axis Bx of the through-hole is set parallel to a rotational axis of the main shaft 83. A bearing surface 104 for receiving a head portion of the bolt 103 is formed at an outer end of the attachment boss 102, orthogonally to the center axis Bx of the through-hole. Therefore, the bolt 103 has an axis Vx orthogonal to the center plane in the left-right direction of the vehicle body, and is screwed into the crankcase 32 while penetrating the clutch cover 93. The bolt 103 produces a connecting force acting on the clutch cover 93 in a direction orthogonal to the center plane in the left-right direction of the vehicle body.

As illustrated in FIG. 8, the clutch cover 93 is integrally formed, at its outer periphery, with a plurality of knock pin bosses 105 for accommodating the knock pins described later. The knock pin bosses 105 include a third knock pin boss 105*a* disposed at an uppermost position, a fourth knock pin boss 105*b* disposed at a frontmost position, a fifth knock pin boss 105*c* disposed below the fourth knock pin boss 105*b* and on the front side of the third knock pin boss 105*a*, and a sixth knock pin boss 105*d* disposed below the fourth knock pin boss 105*b* and on the rear side of an imaginary vertical plane Vp containing the center axis Mx of the main shaft 83.

As depicted in FIG. 9, the clutch cover 93 is laid on the crankcase 32 at a mating surface 106 which is inclined toward the inner side in the vehicle width direction in going toward the rear side of the vehicle. The third knock pin boss 105*a* is formed with a third receiving hole 107 opening in the mating surface 106. A knock pin 108 is fitted into the third receiving hole 107 with a third embedment amount L3. The knock pin 108 is formed of a cylindrical body having an axis parallel to the rotational axis of the main shaft 83. The third receiving hole 107 defines a cylindrical space coaxial with and equal in diameter to the knock pin 108. The embedment amount is specified by the length of a center axis of the knock pin 108.

The crankcase 32 is formed therein with a third insertion hole 109 continuous from the third receiving hole 107 of the third knock pin boss 105*a*. The knock pin 108 is inserted into the third insertion hole 109 with a third insertion amount T3. The insertion amount is specified by the length of a center axis of the knock pin 108 entering the insertion hole. The length of the knock pin 108 is specified by the sum of the third embedment amount L3 and the third insertion amount T3.

The fourth knock pin boss 105*b* is formed with a fourth receiving hole 111. The knock pin 108 is fitted into the fourth receiving hole 111 with a fourth embedment amount L4 which is larger than the third embedment amount L3. The knock pin 108 is formed of a cylindrical body having an axis parallel to the rotational axis of the main shaft 83. The fourth receiving hole 111 defines a cylindrical space coaxial with and equal in diameter to the knock pin 108.

The crankcase 32 is formed therein with a fourth insertion hole 112 continuous from the fourth receiving hole 111 of the fourth knock pin boss 105*b*. The knock pin 108 is inserted into the fourth insertion hole 112 with a fourth insertion amount T4 which is smaller than the third insertion amount T3. As the knock pins 108, knock pins having a common length are used (that is, L3+T3=L4+T4). Here, the knock pin 108 is fitted into the fifth knock pin boss 105*c* with the third embedment amount L3, like in the case of the fourth knock pin boss 105*b*. Similarly, the knock pin 108 is fitted into the sixth knock pin boss 105*d* with the fourth embedment amount L4, like in the case of the third knock pin boss 105*a*.

The knock pins 108 are embedded in the crankcase 32 and the clutch cover 93 while crossing the mating surface 106, and position the clutch cover 93 relative to the crankcase 32 along the mating surface 106. When the bolt 102 is screwed into the crankcase 32, a force for shifting in parallel to the mating surface 106 acts on the clutch cover 93. The shifting force is positively supported by the knock pins 105*b* and 105*c* located on the outer side in the vehicle width direction. As a result, concentration of stress locally generated in the clutch cover 93 by the action of the knock pins 108 is reduced. The strength of the clutch cover 93 is enhanced by only controlling the embedment amounts of the knock pins 108. In this instance, since the bolts 102 each have an axis Vx orthogonal to the center plane in the left-right direction of the vehicle body, the bearing surfaces 104 are aligned in parallel to the center plane in the left-right direction of the vehicle body, and the design of the vehicle is kept favorable. Since the plurality of knock pins 108 have a common length, management of manufacture can be simplified.

What is claimed is:

1. An engine comprising:

a crankcase;

a rotary shaft that is rotatably supported on the crankcase, the rotary shaft having a protruding end thereof protruding to outside from the crankcase;

a cover that is connected to the crankcase at a mating surface of the cover inclined toward an inner side in a vehicle width direction in going downward when the engine is mounted to a vehicle body, the cover covering the protruding end of the rotary shaft; and attachment bosses that are formed to be integral with the cover, have a predetermined height from the mating surface, and accept fastening members for fastening the cover to the crankcase.

2. The engine according to claim 1, wherein the rotary shaft is a crankshaft, and the cover is a power transmission mechanism cover covering a power transmission mechanism that is fixed to the crankshaft on an outside of the crankcase, the power transmission mechanism transmitting power from the crankshaft to a camshaft.

3. The engine according to claim 1, wherein the rotary shaft is a crankshaft, and the cover is a generator cover covering a generator that is connected to the crankshaft on an outside of the crankcase.

4. The engine according to claim 3, wherein a to-be-detected body has reluctors arranged in an annular pattern coaxially with the crankshaft and detected by a pulser sensor, the to-be-detected body being fixed to the crankshaft between the generator and the crankcase, and a lower end of the mating surface is located on the inner side in the vehicle width direction further than the reluctors.

5. The engine according to claim 4, wherein the pulser sensor is attached to the crankcase, the pulser sensor having an axis thereof orthogonal to a rotational axis of the crankshaft.

6. The engine according to claim 5, wherein the crankcase is formed with a casing wall defining an opposed mating surface that receives the mating surface of the generator cover at an outer end while surrounding the generator.

7. The engine according to claim 6, wherein an upper end of the opposed mating surface is located on an outer side in the vehicle width direction further than the reluctors.

8. The engine according to claim 7, wherein the pulser sensor is attached above a horizontal plane containing the rotational axis of the crankshaft.

9. The engine according to claim 1, further comprising:

a plurality of knock pins that are embedded in the crankcase and the cover while crossing the mating surface, and position the cover relative to the crankcase along the mating surface, wherein when a direction of a connecting force of the fastening member is inclined relative to a perpendicular line orthogonal to the mating surface, at least one of knock pins located on the outer side in the vehicle width direction, out of the plurality of knock pins, has an embedment amount into the cover larger than those of other knock pins.

10. The engine according to claim 9, wherein the fastening member is a bolt having an axis orthogonal to a center plane in a left-right direction of the vehicle body.

11. The engine according to claim 9, wherein the plurality of knock pins have a same length.

12. The engine according to claim 10, wherein the plurality of knock pins have a same length.

* * * * *